United States Patent [19]

Baumer

[11] 4,382,408

[45] May 10, 1983

[54] CIRCUIT ARRANGEMENT FOR AN IMPACT FUZE

[75] Inventor: Hans Baumer, Senden, Fed. Rep. of Germany

[73] Assignee: Licentia Patent-Verwaltungs-GmbH, Frankfurt am Main, Fed. Rep. of Germany

[21] Appl. No.: 246,697

[22] Filed: Mar. 23, 1981

[30] Foreign Application Priority Data

Mar. 22, 1980 [DE] Fed. Rep. of Germany ..... 3011230

[51] Int. Cl.[3] ..... F42C 11/02

[52] U.S. Cl. ..... 102/216; 102/210

[58] Field of Search ..... 102/206, 210, 216, 262, 102/264

[56] References Cited

U.S. PATENT DOCUMENTS

| | | | |
|---|---|---|---|
| 3,486,452 | 12/1969 | Glowacki | 102/210 |
| 3,670,653 | 6/1972 | Lunt et al. | 102/210 |
| 3,703,867 | 11/1972 | Madlener et al. | 102/210 |
| 3,786,758 | 1/1974 | Zimmerman | 102/216 |
| 3,850,102 | 11/1974 | Morrow | 102/210 |
| 3,926,120 | 12/1975 | Williams et al. | 102/210 |
| 4,009,662 | 3/1977 | Riparbelli | 102/216 |

FOREIGN PATENT DOCUMENTS

| | | | |
|---|---|---|---|
| 2255547 | 5/1974 | Fed. Rep. of Germany | 102/210 |
| 2535748 | 2/1977 | Fed. Rep. of Germany | 102/210 |

OTHER PUBLICATIONS

"Piezoxide-Wandler" Edited by Valvo GmbH, 1973, pp. 43–45.

*Primary Examiner*—Charles T. Jordan
*Attorney, Agent, or Firm*—Spencer & Kaye

[57] ABSTRACT

An impact fuze for barrel weapon ammunition of the type whose velocity of flight continuously decreases from the time of firing with increasing duration of flight, including a circuit arrangement for avoiding the actuation of a detonation when the impact sensor of the fuze impinges on a rain drop. The circuit arrangement is connected to the impact sensor to increase the detonation response sensitivity of the entire impact fuze during flight of the fuze.

9 Claims, 2 Drawing Figures

CIRCUIT ARRANGEMENT FOR AN IMPACT FUZE

BACKGROUND OF THE INVENTION

The present invention relates to a circuit arrangement for an impact fuze for barrel weapon ammunition. More particularly, the present invention is directed to an impact fuze for such ammunition which has been provided with a circuit arrangement for avoiding the actuation of a detonation when the impact fuze impinges on rain drops.

Such impact fuzes are often used to fight flying targets but can also be employed against ground and water target objects. The impact fuze may be any desired type, for example, a piezoelectric fuze or a mechanical fuze.

In some applications, particularly when combatting flying targets, the detonation upon impact must be reliably actuated when the fuze impacts on very thin metal sheets, possibly under a very flat impact angle. For that reason, in such cases, the sensitivity of the fuze, i.e., the force which will produce a corresponding detonation signal, must be set to be so high that impinging rain drops may inadvertently actuate a detonation before the actual target has been reached. The same applies, of course, also for snow and hail.

Various rain drop safety devices for impact fuzes are already known. However, they all prevent the actuation of a detonation signal by the impact sensor when it impinges or rain drops by mechanical arrangements.

SUMMARY OF THE INVENTION

The present invention is based on the realization that for an impact fuze this rain drop safety can be realized in a very effective and simple manner in that it is not necessary in principle to prevent the actuation of a detonation signal by the impact sensor upon impact with a rain drop.

Rather, a circuit arrangement can be connected in series with the impact sensor which circuit arrangement prevents actuation of the detonation, i.e., the firing or detonation circuit, even when the impact sensor emits a detonation signal, if the release criterion for the impact detonation has not yet been met.

The present invention solves the problem of avoiding actuation of detonation by an impact fuze when it impinges on rain drops in a more rational manner, compared to the prior art, and with greater efficiency.

More specifically, the present invention solves the above-mentioned problem in that in an impact fuze for barrel weapon ammunition of the type whose velocity of flight continuously decreases from the time of firing with increasing duration of flight and with the impact fuze including impact sensor means for producing an electrical output signal upon impact and a detonation signal channel connecting the output of said impact sensor means to a detonation circuit, a circuit arrangement is provided for avoiding the actuation of a detonation when the impact sensor means impinges on a rain drop with this circuit arrangement comprising circuit means connected to the impact sensor means for increasing the detonation response sensitivity of the entire impact fuze during flight of the fuze.

According to various embodiments of the invention, the circuit means may continuously or in stages increase the detonation response sensitivity of the entire impact fuze in dependence on the velocity of flight, or may switch the detonation response sensitivity from a first given low value to a second given higher value once at the end of a given duration of flight after firing. Preferably, the circuit means for changing the response sensitivity includes a module disposed in the detonation signal channel for attenuating the output signal emitted by the impact sensor in dependence on the desired detonation response sensitivity of the fuze. For example, the module may be a controllable attenuation member, and a timing circuit, of the type of a clock, connected to the attenuation member for controlling the attenuation of same from the time of firing.

Finally, according to a further feature of the invention, a comparator may be serially disposed in the detonation signal channel so as to transmit to the detonator circuit only those detonation signals which exceed a given threshold value.

The present invention is thus based on the realization that, after a given period of flight, the response sensitivity of the impact fuze should be increased, since its velocity drops in dependence on the time of flight, in such a manner that rain drops finally will no longer have an influence on the impact function of the fuze even after the response sensitivity has been raised. If the response sensitivity is switched only once from a low value to a high value, the dimensioning limits must be selected so that the velocity of the projectile before switching is high enough so that even with a less sensitive impact function, thin metal sheets will actuate the detonator.

DETAILED DESCRIPTION OF THE PREFERRED EMBODIMENT

Figure 1:
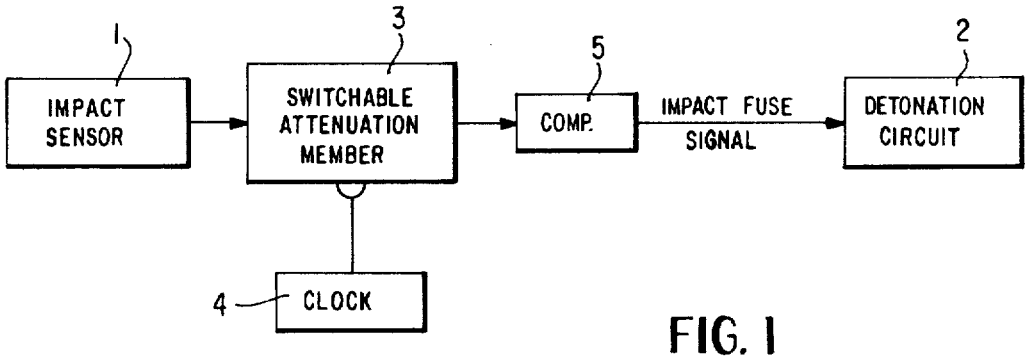
FIG. 1 is a block circuit diagram of a preferred embodiment of the invention.

Referring now to FIG. 1, there is shown an impact fuze including an impact sensor 1 of conventional design for providing an electrical detonation signal upon detection of an impact and a detonation or firing circuit 2, e.g., a detonator cap, connected to the output of the impact sensor 1. According to the invention, connected in the detonation signal channel between the impact sensor 1 and the detonation circuit 2 is a controllable or switchable attenuation member 3 for controllably attenuating the electrical detonation output signal from the impact sensor 1. The degree of attenuation provided by the member 3 is controlled by the output signal from a clock 4. With this arrangement, as the attenuation of the output signal from the impact sensor 1 caused by the attenuation member 3 increases, the sensitivity of the entire impact fuze to an impact detonation decreases.

In operation, firing of the projectile containing the impact fuze according to the invention shown in FIG. 1 causes the clock 4 to start. Since at the time of firing, the velocity of the projectile is high, and hence the fuze would normally be sensitive to detonation by impact with rain drops and the like, the output signal of the clock 4 causes the attenuation member 3 to initially switch or control the sensitivity of the impact fuze to a low value. When the velocity of the projectile decreases during its flight, the output signal of the clock 4 switches or controls the attenuation member 3 to cause the impact fuze to be more sensitive to impacts. With this arrangement, the impact energy exerted by a rain drop on the impact sensor 1 now no longer suffices to effect inadvertent detonation by the fuze.

Preferably, as shown, connected in series in the detonation signal channel between the attenuation member 3 and the detonation circuit 2 is a comparator 5. This comparator 5 transmits only those detonation signals appearing at the output of the attenuation member 3 which exceed a certain threshold value to the detonation circuit 2.

Figure 2:
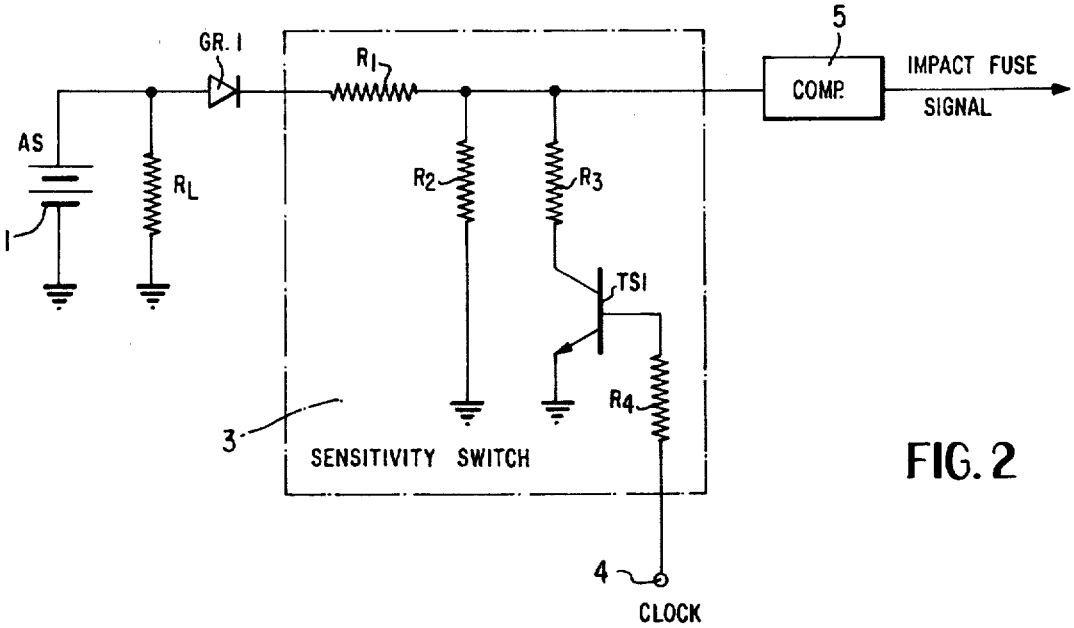
FIG. 2 is a circuit diagram showing the embodiment of FIG. 1 in more detail.

In the specific circuit arrangement of an impact fuze according to the invention shown in FIG. 2, wherein like components to those of FIG. 1 are provided with the same reference numerals, the impact sensor 1 includes an impact sensitive device AS for providing an electrical voltage signal corresponding to an impact and a load resistor $R_L$ connected in parallel. The impact sensor 1 is connected via a protective diode Gr 1 and the attenuation member or sensitivity switch 3, which, as shown, is a controllable or switchable voltage divider, to the comparator 5. The controllable voltage divider comprises a voltage divider $R_1$, $R_2$ whose divider ratio is controllable by means of the series connection of a further resistor $R_3$ and the emitter-collector path of a transistor TS1 connected in parallel with the resistor $R_2$. The base of the transistor TS1 is connected via a further resistor $R_4$ to the output of the clock 4. The impact sensor 1 may be of the same type as used in the firing circuits according to U.S. Pat. Nos. 3,703,867, 3,670,653 and 3,486,452 or German Auslegeschrift No. 22 55 547 (FIG. 3). The impact sensor of the kind described in the book "Piezoxide-Wandler", edited by VALVO GmbH, 1973, pp. 43–45, may likewise be used.

If, in the circuit of FIG. 2, the impact sensing device AS transmits, after an impact, a voltage to a load resistor $R_L$, the impact signal will travel via the protective diode Gr 1 and the switchable or controllable voltage divider of the sensitivity switch 3 to the comparator 5. If the emitted voltage is sufficiently large so that the comparator threshold voltage is exceeded, the comparator 5 will provide an output signal to cause detonation to take place. From the instant of firing until the desired preset time of switching of the sensitivity of the impact fuze, the clock 4 transmits a logic "1" to the sensitivity switch 3. The logic "1" signal causes the transistor TS1 to be rendered conductive so that the ohmic resistors $R_2$ and $R_3$ are connected in parallel. This causes the impact fuze to be placed in its nonsensitive (low sensitivity) position. At the end of the given period of time, the output of the clock 4 becomes a logic "0". This signal causes the transistor TS1, seen as a switch, to no longer be conductive. The voltage divider then comprises only resistors $R_1$ and $R_2$, and the impact fuze is placed in its high sensitivity position.

Any known type of time generator can be used as the clock 4. For example, the clock 4 may be a bistable flip circuit if the sensitivity switch 3 is to be switched between a low and a high sensitivity condition as described above. Alternatively, if switching between a lower and a higher response sensitivity value is to take place more than once, or if the response sensitivity is to be controlled continuously in dependence on the velocity of flight, the same circuit as shown in FIG. 2 can be used, but the control signal for the transistor TS1 must be changed. That is, the base of the transistor TS1 is no longer charged with a simple switching signal, but with a control signal whose amplitude depends on the desired response sensitivity and which comes from the clock source 4. Preferably, with such a control signal the transistor TS1 is a MOS-field effect transistor (MOS-FET).

It is to be understood that the above description of the present invention is susceptible to various modifications, changes and adaptations, and the same are intended to be comprehended within the meaning and range of equivalents of the appended claims.

What is claimed is:

1. In an impact fuze for barrel weapon ammunition of the type whose velocity of flight continuously decreases from the time of firing with increasing duration of flight, said impact fuze including impact sensor means for producing an electrical output signal upon impact and a detonation signal channel connecting the output of said impact sensor means to a detonation circuit; a circuit arrangement for avoiding the actuation of a detonation when said impact sensor means impinges on a rain drop comprising circuit means connected to said impact sensor means for increasing the detonation response sensitivity of the entire said impact fuze furing flight of said fuze.

2. An impact fuze as defined in claim 1 wherein said circuit means includes means for continuously increasing the detonation response sensitivity of the entire said impact fuze in dependence on the velocity of flight.

3. An impact fuze as defined in claim 1 wherein said circuit means includes means for increasing the detonation response sensitivity of the entire said impact fuze in stages in dependence on the velocity of flight.

4. An impact fuze as defined in claim 1 wherein said circuit means includes means for switching said detonation response sensitivity from a first given low value to a second given higher value once at the end of a given duration of flight after firing.

5. A detonation fuze as defined in claim 2, 3 or 4 wherein said circuit means include a module means disposed in said detonation signal channel for attenuating the output signal emitted by said impact sensor in dependence on the desired detonation response sensitivity of said fuze.

6. A detonation fuze as defined in claim 5 wherein the module means comprises a controllable attenuation member, and a timing circuit, of the type of a clock, connected to said attenuation member for controlling the attenuation of same from the time of firing.

7. An impact fuze as defined in claim 6 wherein said controllable attenuation member is a voltage divider whose dividing ratio can be varied electronically.

8. An impact fuze as defined in claim 2, 3 or 4 further comprising comparator means disposed in said detonation signal channel for transmitting to the detonator circuit only those detonation signals which exceed a given threshold value.

9. An impact fuze as defined in claim 5 further comprising comparator means disposed in said detonation signal channel for transmitting to the detonator circuit only those detonation signals which exceed a given threshold value.

* * * * *